United States Patent [19]

Sacks

[11] 4,400,048

[45] Aug. 23, 1983

[54] ELECTRICAL CONNECTOR WITH RESILIENT PULLING EYE

[75] Inventor: Norman M. Sacks, Westport, Conn.

[73] Assignee: Burndy Corporation, Norwalk, Conn.

[21] Appl. No.: 309,857

[22] Filed: Oct. 8, 1981

[51] Int. Cl.[3] ..... H01R 13/62

[52] U.S. Cl. ..... 339/46; 339/110 R

[58] Field of Search ..... 339/46, 109, 110, 14 L, 339/61 R, 143 C, 75 R; 174/11 BH

[56] References Cited

U.S. PATENT DOCUMENTS

| | | | |
|---|---|---|---|
| 3,646,503 | 2/1972 | Tachik | 339/110 R |
| 3,656,057 | 4/1972 | Deluca et al. | 324/133 |
| 3,668,614 | 6/1972 | Ball | 339/111 |
| 3,720,904 | 3/1973 | Desio | 339/34 |
| 3,725,846 | 4/1973 | Strain | 339/61 R |
| 3,753,203 | 8/1973 | Link | 339/14 L |
| 4,175,815 | 11/1979 | Anderson et al. | 339/61 R |

*Primary Examiner*—Joseph H. McGlynn
*Assistant Examiner*—David Pirlot
*Attorney, Agent, or Firm*—Howard S. Reiter

[57] ABSTRACT

In a separable electrical connector for high voltage applications which includes a pulling eye enabling the connector to be gripped by a "hotstick" tool for engaging and disengaging the connector relative to a mating part, the pulling eye is provided with resilient, rubber-like ears for biasing the operating surface of the hotstick away from the pulling surface of the pulling eye. The resilient means is positioned alongside the pulling surface of the eye so that it is not interposed directly between the operating surface of the hotstick and the pulling surface of the eye. The resilient means provides resiliency in the engagement between the hotstick and the connector to assure that a secure grip and proper alignment are maintained. The resilient means eliminates undesirable slack and wobble in the engagement of the hotstick with the connector.

14 Claims, 4 Drawing Figures

ELECTRICAL CONNECTOR WITH RESILIENT PULLING EYE

BACKGROUND OF THE INVENTION

This invention relates generally to electrical connectors or terminators, and more particularly, to electrical connectors used for high voltage applications, such as those applied to the terminals of transformers.

In the area of high voltage connectors, there is a need to safely connect and separate the connector, and a mating electrical part often called a "bushing". Such connectors characteristically take the shape of an elbow. One leg of the elbow is attached to a conductor such as a cable through which electrical current can be drawn. The other leg of the elbow, referred to as the barrel, is adapted to engage the bushing. The elbow provides a convenient way to connect and disconnect the cable to and from a mating part such as a bushing on a transformer. The connection is accomplished simply by pushing the elbow onto the bushing while the disconnect is accomplished simply by pulling the elbow off of the bushing.

The elbow contains an electrically conductive member such as an elongated contact to bring the current from the bushing to the cable when the elbow is in operative relationship with the bushing. A typical elbow connector has its current transmitting material substantially encircled by a housing molded from resilient insulation material. The high voltage cable is inserted into the elbow and electrically and mechanically secured thereto.

The elbow is disconnected from and connected to the bushing through a pulling eye which is preferably located near the apex of the elbow. The pulling eye, which is located in alignment with the longitudinal axis of the barrel, enables an operator to grasp the pulling eye from a safe distance with a suitable elongated hotstick tool. Once so grasped, the operator pulls on the hotstick to pull the elbow off of the bushing thereby disconnecting the electrical circuit from the utilization device such as a transformer. If the elbow is to be connected to the bushing, on the other hand, the operator aligns the elbow with the bushing and pushes the elbow onto it with the hotstick.

Because of the high voltage being carried, an electrical arc can be caused between the elbow and the bushing when the elbow is being connected or disconnected. If an accidental fault closure is experienced, the speed of the connection becomes important since the arc energy level is sufficiently increased in proportion to the magnitude of the fault current and its duration. It is accordingly desirable that closure be accomplished with due speed in order to minimize the duration of any such arc. The more rapid and positive the connection can be accomplished with the hotstick, the greater the safety of the operator. Anything which retards the speed at which the elbow is connected may decrease the safety of the operator.

One problem experienced with prior art devices, however, is that the operator cannot always position the hook securely and firmly on the pulling eye during engagement of the hotstick with the elbow. As a result, when the hotstick is used to connect the elbow, the hook may slip relative to the eye and skew the axis of the hotstick.

Accordingly, it is a primary object of the present invention to provide an improved elbow connector which can be securely gripped and easily held in proper alignment by ordinary hotstick tools.

It is another object of the present invention to facilitate the insertion of an elbow onto a bushing using a hotstick tool.

It is another object of the present invention to provide a pulling eye for an electrical connector which prevents the hotstick hook from wobbling or slipping relative thereto.

SUMMARY OF THE INVENTION

Briefly stated, and in accordance with the present invention, there is provided an electrical connector with a pulling means adapted to enable an operator to quickly and positively connect and disconnect the connector from its mating part. The operator can engage a hook-type tool with the pulling eye means rapidly and positively in preparation for connection or disconnection. Upon engagement, the hook remains securely and firmly seated against and in alignment with the pulling eye means free of slack and wobble.

BRIEF DESCRIPTION OF THE DRAWINGS

Other objects and advantages of the present invention will become apparent upon reading the following detailed description with reference to the drawings wherein.

While the present invention is described in connection with a preferred embodiment and associate method of use thereof, it should be understood that it is not intended to limit the invention to this embodiment and method of use. On the contrary, it is intended to cover all alternatives, modifications and equivalents as may be included within the spirit and scope of the invention as defined by the appended claims.

DETAILED DESCRIPTION OF THE INVENTION

Figure 2:
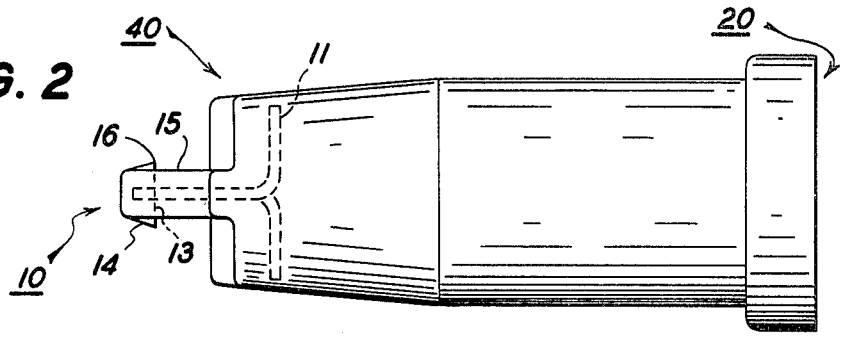
FIG. 2 is a top view of the embodiment in FIG. 1.
Figure 1:
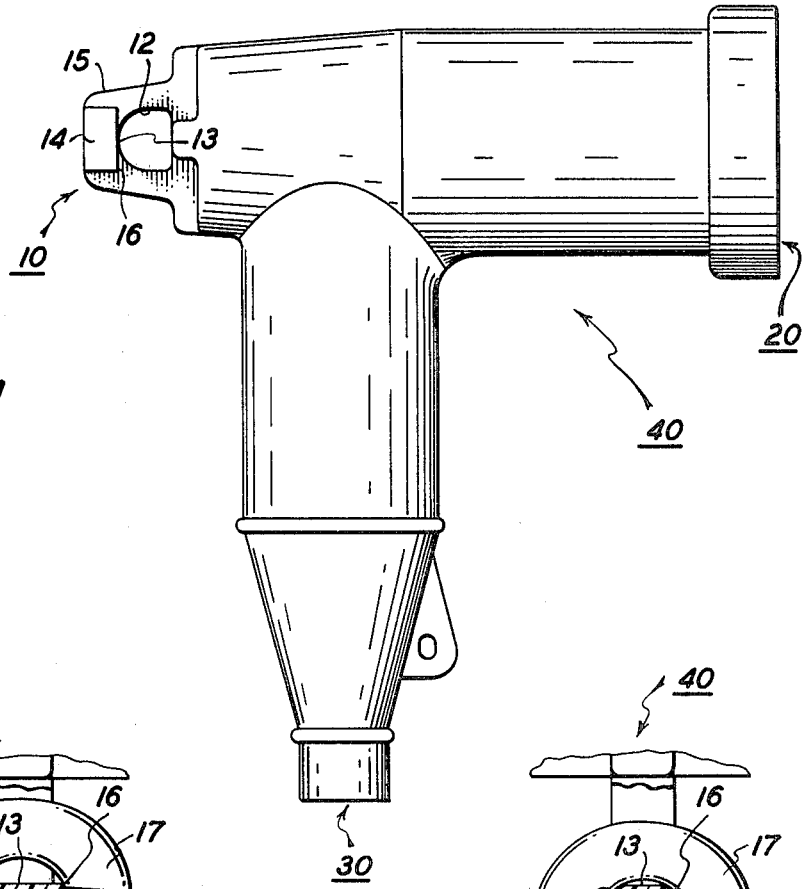
FIG. 1 illustrates a side view of a preferred embodiment of the pulling member on the connector.

Referring more particularly to the drawings, wherein like reference numerals have been used throughout to designate like elements, FIGS. 1 and 2 illustrate schematically one embodiment of the pulling member configuration.

The connector, generally designated as 40, can be any suitable type for its particular application. In the embodiment shown in the drawings and described herein, the connector has an elbow configuration with two legs, generally designated 20 and 30. Leg 20, the barrel portion of the elbow, mates with a bushing (not shown). The bushing can be connected to a terminal of a transformer or other high voltage electrical device. Leg 30 of the elbow is adapted to be electrically joined to the conductor such as a shielded cable. The barrel of the elbow contains a suitable bushing opening in its right end and pulling member 10 on its left end. The center line of the pulling member and the opening for receiving the bushing are located approximately on the axis of the barrel.

Any suitable way of operatively joining the connector and bushing can be used. For instance, the bushing opening on the elbow can be in the form of a female-type opening into which a male-type bushing can be placed. In operating position, the two are disconnectably engaged and can be quickly separated by the female portion, or elbow, being pulled off the male portion. To bring back into operation, the elbow is reconnected to the bushing simply by pushing the elbow onto it. The elbow is covered with an insulating, resilient material which can be made integral therewith. Other conventional features of an elbow of this type, such as the conductor and an elongated contact member to transmit electrical current from the bushing to the cable, are contained within the housing. Reference is had to U.S. Pat. No. 3,656,057 which discloses a representative elbow connector.

The function of the pulling member, or eye, is to provide a means to quickly connect and disconnect the elbow to and from the bushing. This is done at a safe distance by an operator in conjunction with what is generally referred to as a "hotstick". The pulling eye, which is preferably located approximately at the apex of the elbow, contains tool opening 12. The hotstick tool is a long, for example, 6 or 8 foot, insulated rod which has a hook-type tool on the end. Standing away from the elbow itself, the operator grasps one end of the hotstick and guides the hook end into the pulling eye. Once the hook is fully and properly located in the pulling eye, the operator can connect or disconnect the elbow to or from the bushing. The operator aligns the hotstick so that it places force against the pulling eye in a direction approximately longitudinally with the barrel. The cable attached to the elbow, of course, remains joined to and moves with the elbow during connect and disconnect operations.

The operating end of the hotstick has a hook-type tool adapted to engage with pulling eye 10. The same end of the hotstick has a general configuration adapted to abut against the portion of the elbow approximately encircling the pulling eye. The hotstick also has a means to enable the operator to draw the hook into its operating end so that the operating end of the hotstick firmly abuts the elbow while the hook firmly engages the pulling eye. It is after this last condition is reached that the operator can safely push or pull on the other end of the hotstick with such force to connect or disconnect the elbow to or from the bushing.

Pulling eye 10 is generally covered with a resilient, elastomeric material. This can be any suitable material which is somewhat elastic as the hook is pulled against it. As can be seen in FIG. 2, eye 15 can have embedded in it a reinforcing member 11 which gives it it's ultimate rigidity. This member allows the eye to retain its basic shape as the elbow is pulled from the bushing. The reinforcing member can be made of any suitable material such as a strong metallic material.

As can be seen in FIG. 1, eye 15 has opening 12 adapted to receive the hotstick hook. The eye opening has a tool engaging surface, or pulling surface, 13 against which the hook is placed in order to properly engage the tool with the elbow in preparation for connecting or disconnecting it relative to the bushing. Surface 13 is preferably coincident with, but normal to, the longitudinal axis of the barrel of the elbow.

There are two projections on the pulling eye which greatly aid in the proper gripping and seating of the hotstick hook. As can be better seen in FIG. 2, the embodiment shown is a pair of ears 14, or lugs, located on the sides of the pulling eye adjacent hook engaging surface region 13. The ears are angled back from the tool engaging surface to give clearance for the sides of the hook. The ears are preferably located in this portion of the pulling eye so that they are not interposed directly between the operating surface of the hook and the hook engaging surface of the eye. Although shown as ears, these projections can take any convenient form such as tabs, flaps or any other suitable protuberance configuration that acts on the hook in the manner desired. In addition, although ears 14 are depicted in the drawings as being substantially adjacent hook engaging surface region 13, they can extend around the pulling eye opening if desired.

The primary purpose of the ears is to eliminate wobble, and the occurrance of a slack condition, between the hook and the pulling eye as the hotstick is engaged with the elbow in preparation for connection or separation of the elbow. They enable the hook to firmly and securely grip the pulling eye and maintain alignment between the hotstick tool and connector. Upon insertion of the hook into the pulling eye opening, the operator must draw the hook into the operating end of the hotstick so that the end of the hotstick seats itself against the elbow housing in the area around the pulling eye. The hook is preferably drawn into the hotstick until the operating end of the hotstick seats on the elbow housing and the hook is in operative relationship with the pulling eye. It is important that the axis of the elbow be aligned with the axis of the hotstick and hook. The operator then clamps the hook to the hotstick and is ready to connect or disconnect the elbow to or from the bushing.

The operator is at all times at the other end of the hotstick, usually 6 to 8 feet from the elbow. Because of this, he cannot make a very close visual inspection of the proper seating and alignment of hook and hotstick before clamping the hook in place in preparation for connection or separation. The ears assure that the proper seating and alignment take place between the hook and eye before clamping and that the hook remains in positive, continuous and firm contact with the eye.

The ears, resiliently engaging the hook, provide a reactive force on the hook's inner surface as the hook is drawn into the hotstick. This force is generally opposite to that applied to the hook. The action is similar to that of a spring means due to the elastic nature of the ears. The resilient material, such as a rubber-like material, used on the ears is preferably one that tends to force the gripping surface of the hook away from hook engaging surface 13 during such times that force is not being applied to the hotstick to disconnect the elbow. The resiliency of the material should also enable the hook to operatively bear against surface 13 to disconnect the elbow as the operator pulls on the hotstick for this purpose. This assures that at all times there is a secure gripping of the pulling eye by the hook and the hook is maintained in proper alignment with the elbow. The ears are preferably widely-spaced within the hook's inner surface upon engagement therewith to provide maximum stability to the hook. Once the hook contacts and compresses the ears and is clamped, the hook does not slip or wobble as can be the case when the ears are not used.

Figure 3A:
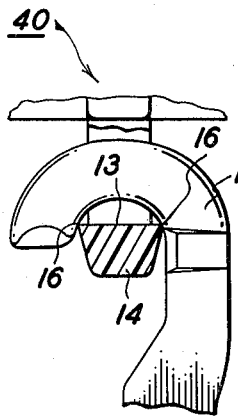
FIG. 3*a* is a schematic illustration of the hook-type tool as it begins to become engaged on the pulling member.
Figure 3B:
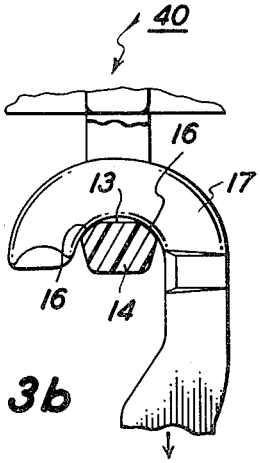
FIG. 3*b* is a schematic illustration of the hook-type tool after it has engaged on the pulling member to disconnect the connector from the bushing.

As can be seen more clearly in FIGS. 3*a* and 3*b*, the action of ears 14, and particularly ear edges 16, can be observed. FIGS. 3*a* and 3*b* show only the region of the pulling eye containing ears 14 and hook engaging surface 13 relative to hook 17. FIG. 3*a* depicts the orientation of these members as the hook is pulled by the operator into the hotstick for clamping. It is noted that the first portions of the pulling eye to contact hook 17 are edges 16. Since there is a two point contact between hook 17 and pulling eye 10, a continuous, firm and secure seating takes place. As the hook is pulled by the operator to install the hotstick, downward in FIG. 3*a*, and the hook moves relative to ears 14, the elastic nature of the ears is such that they begin to deform or deflect. The compression of ears 14 at 16 result in a spring-like force against the hook from the first moment of contact of the hook onto the pulling eye. Any relative movement, or slip, between these surfaces is thereby prevented.

The operating end of the hotstick eventually seats on the elbow and the hook is clamped to the hotstick. As the ears deform or deflect, the force placed on the connector housing is sufficient to maintain the hook against the pulling eye, but insufficient to begin the separation of the elbow from the bushing should the two be connected. In other words, the force against the hook provided by the ears is less than that required to separate the elbow from the bushing. The ears essentially bias the hook away from the pulling region during this stage of the procedure.

After the hook is clamped, the operator is then in a position to pull the hotstick with sufficient force to remove the elbow from the bushing or push the elbow onto the bushing. The spring-like action of the ears on the hook assure there is no slack in the hook and that the hook does not wobble or misalign or slip relative to the connector. This enables the operator to connect or disconnect the elbow in a rapid, positive action. This, in turn, assures maximum safety to the operator. If a disconnection is to be completed, the force required to accomplish separation tends to make the resilient material of the ears and pulling eye deform as shown in FIG. 3*b*. The resilient material deforms filling the inner surface of the hook so that the hook can operably act on reinforcing member. This provides a firm and secure seating of the hook on the pulling member and enables the force applied to the hotstick to be transmitted to the connector.

It should be understood that the foregoing description is only illustrative of the invention. Various alternatives and modifications in the structural and functional features of the pulling eye can be devised by those skilled in the art without departing from the invention. Accordingly, the present invention is intended to embrace all such alternatives, modifications and variations which fall within the spirit and scope of the appended claims.

What is claimed is:

1. An electrical connector of the type adapted to telescopically engage a mating part requiring significant force for insertion and withdrawal, comprising:

a housing having a contact opening therein, an elongated contact member mounted within the opening, a tool opening within the housing for receiving a pulling tool, a tool engaging surface within the tool opening for receiving force transmitted from the tool in a direction axially aligned with the axis of the contact member and tending to separate the contact member from a mating part, resilient means on the housing adjacent the engaging surface for resiliently spacing a tool from the tool engaging surface, and the resilient means resisting movement of a tool toward the tool engaging surface with a force substantially less than the force required to disengage the contact member from the mating part.

2. An electrical connector in accordance with claim 1 wherein the tool engaging surface is substantially normal to the axis of the contact member; the resilient means being spaced from the tool engaging surface in a direction normal to the axis of the contact member.

3. An electrical connector in accordance with claim 2 wherein the resilient means comprises a pair of resilient elements disposed on substantially opposite sides of the tool engaging surface.

4. An electrical connector in accordance with any of claims 1, 2 or 3 wherein the housing includes a covering of material which is inherently resilient, and the resilient means is formed integrally with the covering.

5. In an electrical connector of the type having a conductor means attached thereto and being disconnectably engageable with a mating electrical means, the connector enabling the transmission of electrical current between the connector means and the mating means when engaged with the mating means, the improvement comprising:

a pulling member on the connector for operably receiving a hook-type tool thereon adapted to connect and disconnect the connector to and from the mating means, the pulling member having gripping means for resiliently engaging the tool whereby the tool is prevented from slipping and wobbling relative to the pulling member and is maintained in alignment with the pulling member.

6. The connector according to claim 5 wherein the pulling member is located at a position on the connector so that the force applied by the hook is substantially axial with the mating means.

7. The connector according to claim 5 wherein the connector and pulling means are covered with an insulating material.

8. The connector according to claim 5 wherein the gripping means is made of an elastomer.

9. The connector according to claim 8 wherein the pulling member is covered with an elastomer.

10. The connector according to claim 9 wherein the pulling member has embedded therein a material which maintains the basic shape of the pulling member as the elastomer is distorted during the pulling action of the tool during the separation of the connector from the mating means.

11. The connector according to claim 5 wherein the gripping means includes a pair of ears on the pulling member which act together on the hook-type tool for providing a force thereon opposite the force exerted on the hook-type tool as it grips the pulling member.

12. The connector according to claim 11 wherein the ears are made of an elastomer and conform to the inner surface of the hook-type tool as increasing force is placed on the tool whereby the tool firmly engages the pulling member.

13. The connector according to claim 5 wherein the gripping means provides a force on the hook-type tool which is substantially less than the force required to separate the connector from its mating means.

14. An electrical connector of the elbow type, the connector having an electrical cable means attached to one leg of the elbow and having a female barrel configuration on the other leg of the elbow disconnectably engageable with a male mating means, the connector enabling the transmission of electrical current between the cable means and mating means when the barrel is operably placed on the mating means, the improvement comprising:

a pulling eye located approximately at the apex of the elbow along the longitudinal axis of the barrel, the eye being utilized for operably receiving a hook-type tool thereon for connecting and disconnecting the elbow to and from the mating means, the eye having a pair of resilient ears located thereon, one on either side of the eye, against which the hook is to be engaged for gripping the eye, the ears acting together on the inner surface of the hook to prevent the hook from slipping and wobbling relative to the eye when the eye is gripped thereby and to maintain the hook in alignment with the eye.

* * * * *